United States Patent [19]

Bagley et al.

[11] 4,289,798

[45] Sep. 15, 1981

[54] METHOD FOR REDUCING SURFACE GLOSS

[75] Inventors: George E. Bagley; Willard E. McCreary; Werner Rueggeberg, all of Lancaster, Pa.

[73] Assignee: Armstrong World Industries, Inc., Lancaster, Pa.

[21] Appl. No.: 140,102

[22] Filed: Apr. 14, 1980

[51] Int. Cl.[3] ..... B05D 3/06

[52] U.S. Cl. ..... 427/39; 427/41; 427/54.1

[58] Field of Search ..... 422/39, 41, 54.1

[56] References Cited

U.S. PATENT DOCUMENTS

| | | | |
|---|---|---|---|
| 3,669,720 | 6/1972 | Remer | 427/40 |
| 3,725,114 | 4/1973 | Warneke | 427/39 |
| 3,783,004 | 1/1974 | Parker | 427/54.1 |
| 3,918,393 | 11/1975 | Hahn | 427/44 |
| 3,944,709 | 3/1976 | Levy | 427/54.1 |
| 4,197,344 | 4/1980 | Tshudy | 427/44 |

*Primary Examiner*—John H. Newsome

*Attorney, Agent, or Firm*—Dennis M. Kozak; Daniel De Joseph

[57] ABSTRACT

This invention pertains to a method and apparatus for producing a cured resinous coating which exhibits a reduced gloss level. In a preferred embodiment, the cured resinous coating which exhibits a reduced gloss level is a wear resistant coating and is superimposed on a resilient floor covering material.

10 Claims, 3 Drawing Figures

GRAPHIC REPRESENTATION OF THE DATA OF TABLE I

GRAPHIC REPRESENTATION OF THE DATA OF TABLE IV

METHOD FOR REDUCING SURFACE GLOSS

This invention relates to coatings which are at least partially curable by radiant energy.

More specifically, this invention relates to a method and apparatus for reducing the surface gloss exhibited by cured coatings.

In one of its more specific aspects, this invention concerns a corona discharge method and apparatus for treating wet, uncured coatings to reduce the surface gloss exhibited by the coatings when cured.

The resilient flooring industry has done much work pertaining to the development of high gloss wear layer coatings which are curable by radiant energy or a combined radiant energy and moisture cure. These coatings provide abrasion resistance and impart a high gloss appearance to floor coverings. The abrasion resistance provided by these coatings is always a desirable property; however, the high gloss appearance is not, especially in heavily trafficked areas of a floor, since maintenance time is increased. Accordingly, the flooring industry is continually searching for ways to control the gloss levels of these coatings.

Prior art methods of reducing gloss or flatting typically involve the employment of various particulate flatting agents in the wear coating compositions. The use of flatting agents has been generally unsatisfactory since their use results in deglossed coatings which exhibit a reduction in other physical properties. Another method known in the art is steam deglossing. (See U.S. Pat. No. 4,197,344.)

According to this invention there is provided a method for producing a radiant energy cured resinous coating having a reduced gloss level which comprises coating the surface of a substrate with a liquid resinous coating composition curable by radiant energy; treating at least a portion of the surface of the liquid resinous coating with a corona discharge sufficient to reduce the gloss level of the coating in the treated portion; and exposing the liquid resinous coating having a reduced gloss level to a dosage of radiant energy sufficient to polymerize the coating and set the reduced gloss level.

Also according to this invention there is provided a method for producing a combined radiant energy and moisture cured resinous coating having a reduced gloss level which comprises coating the surface of a substrate with a liquid resinous coating composition curable by a combined radiant energy and moisture cure; treating at least a portion of the surface of the liquid resinous coating with a corona discharge sufficient to reduce the gloss level of the coating in the treated portion; exposing the liquid resinous coating having a reduced gloss level to a dosage of radiant energy sufficient to polymerize the radiant energy curable components of the coating and set the reduced gloss level; and, subjecting the radiant energy cured coating to a moisture cure to fully cure the coating.

The coatings to be subjected to corona treatment according to this invention are in liquid form and are broadly classified as resinous coating compositions which are curable by either radiant energy or by a combined radiant energy and moisture cure.

Resinous coating compositions curable by radiant energy which are suitable for use in this invention include free radical initiated ethylenically unsaturated polymerizable compositions, free radical initiated polyene-polythiol polymerizable compositions, and the like. Particularly suitable free radical initiated ethylenically unsaturated polymerizable compositions include urethane acrylates and acrylated polyesters.

Also suitable for use in this invention are resinous compositions curable by a combined radiant energy and a moisture cure such as the liquid urethane acrylate coating compositions taught in U.S. Pat. No. 4,138,299 to N. C. Bolgiano. If a combined radiant energy and moisture curable resinous coating composition is employed in the practice of this invention, it should contain a radiant energy curable content of at least 5%. Preferably, 30 to about 40% of the coating composition will be curable by radiant energy. The present invention, using a coating produced according to U.S. Pat. No. 4,138,299, is demonstrated in Example 41.

The coating compositions can contain conventional amounts of art recognized ingredients such as, for example, heat and light stabilizers, fillers, pigments, and the like.

The subject invention will be more easily understood if explained in conjunction with the attached drawing in which.

Figure 1:
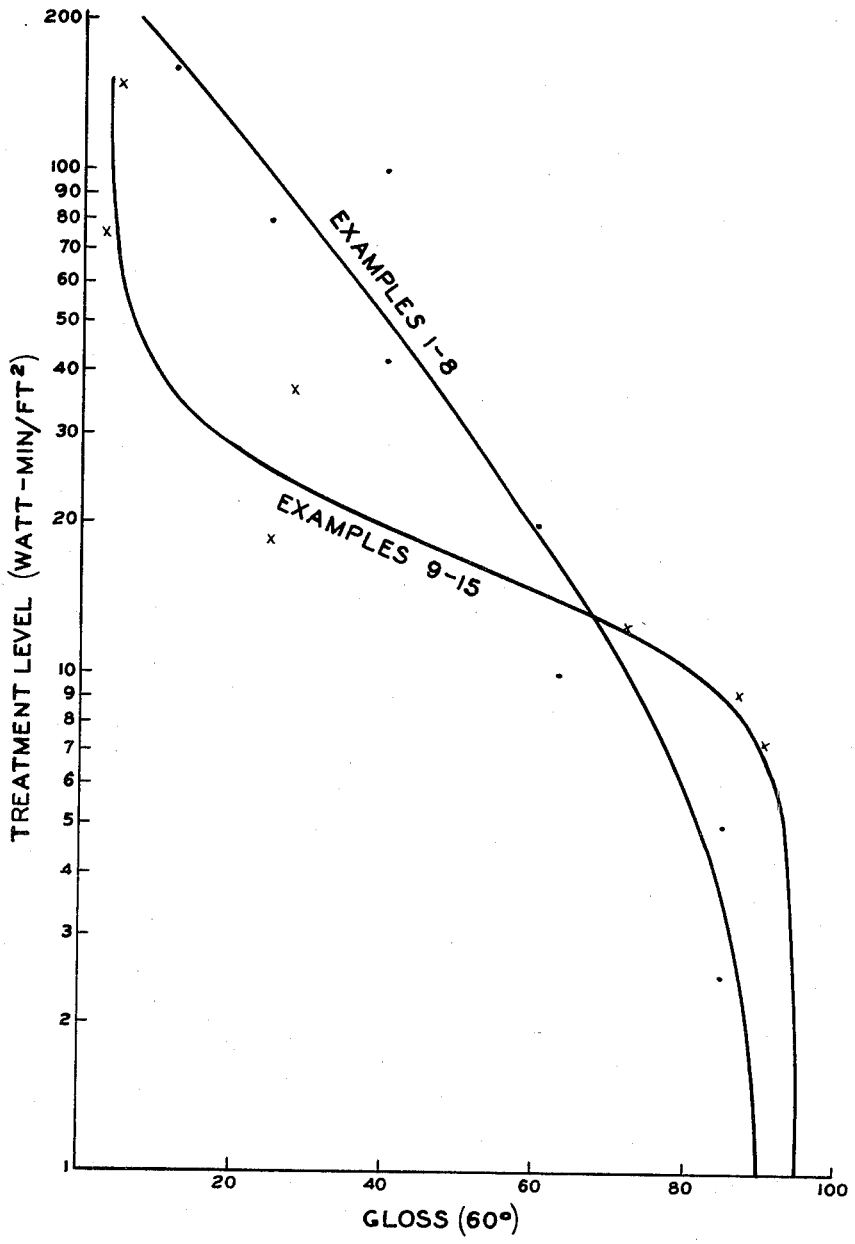
FIG. 1 is a graphic representation of the data of Table I.
Figure 2:
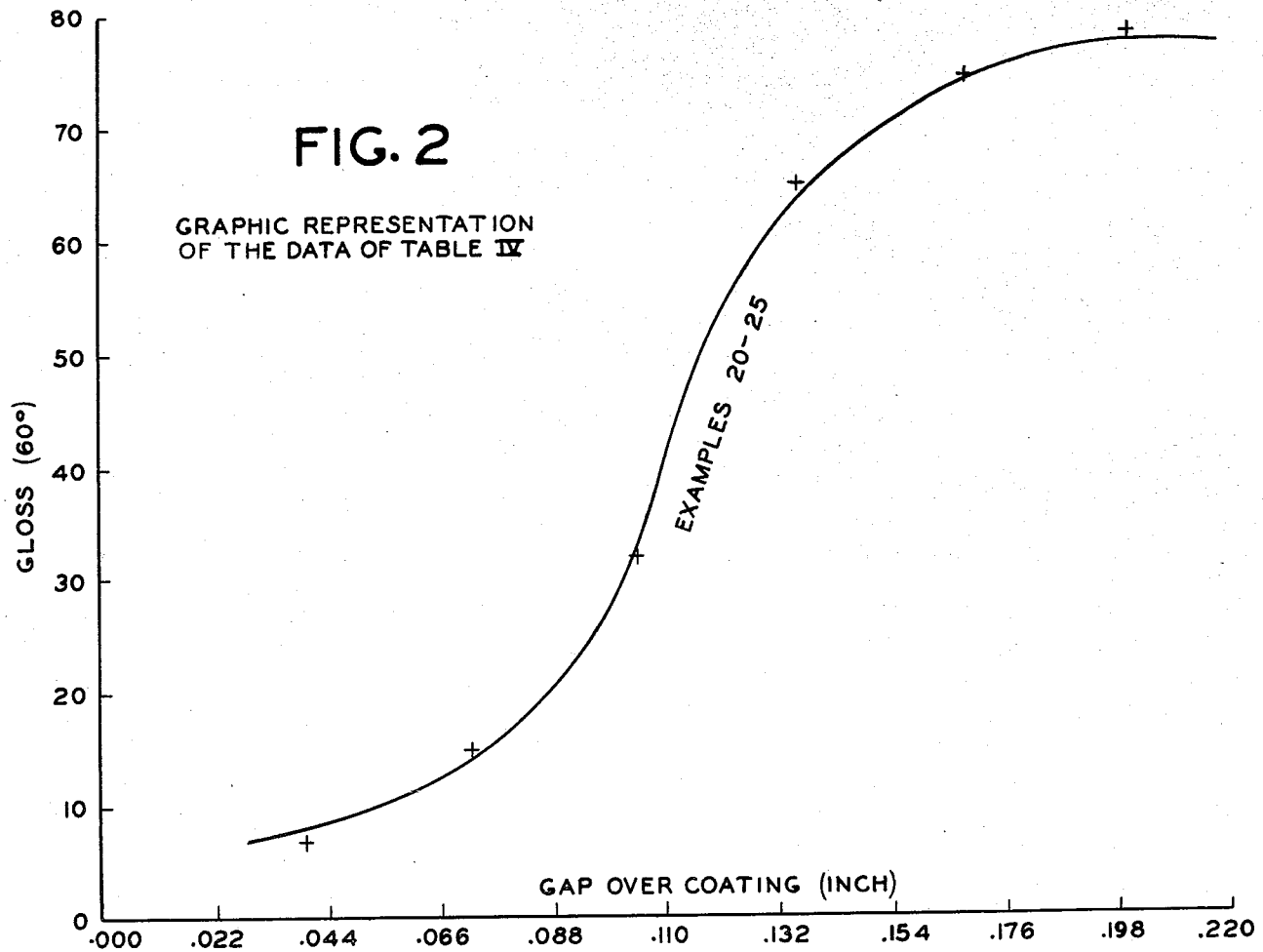
FIG. 2 is a graphic representation of the data of Table IV.
Figure 3:
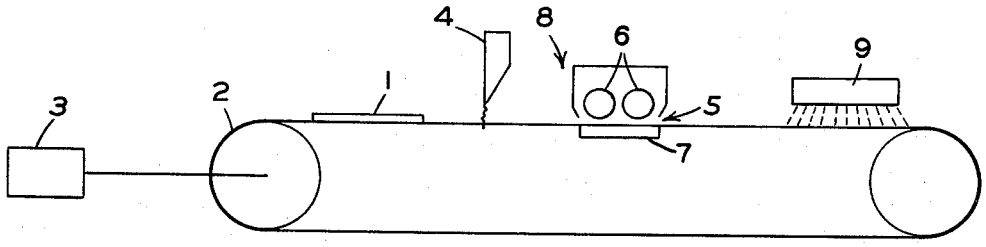
FIG. 3 is a schematic of the apparatus for carrying out the subject invention.

Referring now to the FIG. 3, there is shown material to be coated 1, carried on means for moving 2, driven by drive means 3.

The material to be coated after passing under means for coating 4 where a liquid resinous coating composition is applied, is passed through corona discharge region 5 existing in the gap between electrodes 6 and ground plate electrode 7 of corona discharge means 8. As the coated material passes through corona discharge region 5 the coating is treated with a corona discharge sufficient to degloss the coating. The coated material exits from corona discharge means 8 and passes under curing means 9 where the treated coating on the material is bulk cured.

In the best mode for practicing this invention as a material to be coated 1, in this instance, a commercial filled vinyl floor tile to be wear layer coated, is fed along a 1/32 inch thick silicone-rubber conveyor belt 2, the tile first passes under a conventional curtain applicator 4 where an ultraviolet light curable wear layer coating composition is applied to a thickness of about 6 mils. The silicone-rubber conveyor belt serves as a buffer dielectric for corona treatment. However, rather than a silicone-rubber belt, any conventional nonconductive conveyor system can be employed. Instead of a curtain applicator, other conventional coating applicators such as a roll coater, blade coater, spray coater, screen printer and the like can be employed to apply coating compositions to desired thicknesses, typically, within the range of from about 0.5 to about 20 mils.

Tile 1, which now has a 6 mil thick wet, uncured coating on its surface is fed through the gap existing between the bottom of electrodes 6 and the top ground plate electrode 7 at a conveyor speed within the range of from about 5 to about 100 feet per minute. In this instance the ground plate electrode was positioned beneath the silicone-rubber belt, the belt passing over the top surface of the ground plate, as shown in the drawing. The gap between the bottom of the electrodes 6 and the coating surface on the tile was about 0.124 inch.

Gap settings within a range of from about 0.02 inch to about 0.25 inch have been found suitable for deglossing coatings according to this invention. Alternatively, if only a portion of the surface of the coating is to be deglossed a movable non-conductive mask or shield could be placed on the coating surface such that as the masked coating passes under the corona discharge means only a portion of the surface of coating is treated.

As the corona discharge means 8, use can be made of any commercial unit capable of generating and sustaining the treatment levels needed to degloss coatings. A star electrode corona treater designated "Softal Treater" available from Softal Corporation of America was found suitable for use but exhibited a tendency to arc at high power levels and used considerable amounts of gas.

Particularly suitable for use and preferred in the practice of this invention is the Rueggeberg corona discharge device described in co-pending application Ser. Nos. 128,539 and 128,540 the disclosures of which are incorporated herein by reference. The particular Rueggeberg corona discharge device employed in the practice of this invention consisted of two, 29 inch long, ¼ inch O.D. copper tube electrodes, each encased in 30 inch long quartz tubes having outside diameters of 0.6 inch and wall thicknesses of 0.04 inch, and one aluminum ground plate electrode about 5 inches long and 14 inches wide. The copper tube electrodes were positioned immediately adjacent and parallel to each other at a center line separation of about 2 inches, and the aluminum ground plate electrode was positioned parallel to and a spaced distance from the copper tube electrodes beneath the surface of the silicone-rubber belt carrying the tile. Shrouding the copper tube electrodes was a glass fiber reinforced silicone housing which defined a gas plenum chamber and served to direct an inlet gas or gas mixture, to be ionized, perpendicular to the lengthwise direction of the electrodes and into the gap or corona discharge region. As described in the above-referenced application, the housing serves to provide a corona discharge characteristic of the inlet gas which in this instance was nitrogen. The gas is introduced into the housing at a flow rate of from about 10 to about 45 liters per minute per electrode. As this gas flows into the corona discharge region to be ionized, it serves to force away all contaminating gases. In the case of most ultraviolet radiation curable wear resistant coatings for flooring, contaminating gases include air and oxygen, which inhibit the cure of these coatings. In the operation of the Rueggeberg corona discharge device, to optimize the corona activity of the gas to be ionized, a liquid buffer dielectric/coolant, for example, hydrocarbon or mineral transformer oils, ethylene glycol, glycerine, etc., circulates through the cylindrical passageway created between each copper tube electrode and quartz tube at an average velocity flow of from about 20 to about 30 inches per second. Typically, the dielectric/coolant is circulated at the rate of about 1 gallon per minute.

Selection of a gas or gas mixture employed in the operation of the corona discharge device has a considerable effect on the amount of deglossing achieved. The gas employed affects the activity and uniformity of the corona discharge and, accordingly, the uniformity and amount of deglossing of the coating. The gas is introduced into the active corona region and ionized forming a corona discharge for treating the coating surface. Furthermore, as indicated above, if the cure of the coating is oxygen-inhibited, another purpose of the gas is to provide an inert atmosphere. Typically, these oxygen-inhibited coatings exhibit little deglossing when corona treated in an atmosphere containing a detectable amount of more than about 0.1% oxygen as compared to the amount of deglossing they exhibit in atmospheres containing about 0.1% or less oxygen.

Any suitable gas or gas mixture can be employed. Gases and gas mixtures which have been employed and found suitable for use in this invention include argon, carbon dioxide, nitrogen, helium, nitrous oxide, carbon tetrafluoromethane, sulfur hexaflouride, argon and carbon dioxide, argon and helium, argon and nitrogen, argon and nitrous oxide, helium and carbon dioxide, etc., and the like. It has also been found that a gas or gas mixture containing water vapor at more than about 25% relative humidity produces a smoother corona and a smoother texture on the deglossed surface.

Argon or helium have been found to provide the most deglossing for the coating of Example I. This is believed to be because both gases are very easily ionized.

After corona treatment the tile is conveyed under curing means 9 which in this instance was a bank of ultraviolet lights directing sufficient radiant energy on the coating to completely polymerize it. If the liquid resinous coating composition is curable by a combined radiant energy and moisture cure, curing means 9 will be supplemented by a subsequent moisture cure which can consist of allowing the coating to age at room conditions as taught in U.S. Pat. No. 4,138,299.

The degree of deglossing, the rate of deglossing, and the tendency to regloss after corona treatment and before bulk cure of a particular coating type have been found to be affected by coating composition additives, photoinitiators, coating viscosity, coating thickness and the like. Accordingly, the optimum conditions for deglossing a particular coating can be determined only by experimentation. For example, it has been found possible to degloss the coating of Example I without the use of a photoinitiator. This is believed to be explained by the fact that free radicals are formed by the corona treatment, thus directly initiating the cure mechanism. Table III (below) shows the effect viscosity has on deglossing the coating of Example I. Furthermore, it has been found that if reglossing of a coating after corona treatment is a problem, it is necessary to bulk cure the treated coating immediately upon its exit from the corona treater. However, if reglossing is not a problem, the time between corona treatment and bulk cure is not critical. Also, it has been found that the degree of deglossing achieved is inversely proportional to the coating thickness.

The above findings are provided as broad guidelines to be considered when practicing this invention. The Tables below, set forth and demonstrate in detail the parameters of this invention in relationship to the coating of Example I.

Having described the method and apparatus of this invention, reference is now made to the following examples which further illustrate the invention.

EXAMPLE I

This example demonstrates the preparation of a free radical initiated ethylenically unsaturated polymerizable composition used to produce the data set forth in Tables I–V below.

About 21.9 weight percent of 4,4' diisocyanato dicyclohexylmethane, about 0.05 weight percent 2,6-di-tert-butyl-4-methylphenol, about 0.2 weight percent 2-ethylhexyl acrylate, and about 0.1 weight percent of dibutyltin dilaurate catalyst were introduced into a reaction vessel with agitation.

About 7.2 weight percent 2-ethylhexylacrylate and 10.8 weight percent hexanediol diacrylate were introduced into the reaction vessel with agitation.

The contents of the reaction vessel were agitated for about 10 minutes and about 6.8 weight percent 2-hydroxyethyl acrylate was added to the contents of the reaction vessel at a rate such that the temperature in the reaction vessel did not exceed 130° F.

About 2.2 weight percent 2-ethylhexyl acrylate was introduced into the reaction vessel and the temperature of the reaction vessel was held at 130° F. for about one hour.

The reactor was cooled to about 120° F. and about 17.7 weight percent of the reaction product of 1 mole glycerol, 3 moles of a 7/3 mixture of adipic acid and isophthalic acid and 3 moles of 1,6 hexanediol (Hooker Chemical Triol F-2039-180, MW 960, Hydroxyl No. 175) was rapidly added to the reactor contents. The temperature in the reaction vessel was not allowed to exceed 140° F.

Next, about 16.6 weight percent of a polycaprolactone diol (Union Carbide PCP-0200 diol, MW 540, Hydroxyl No. 207) was added to the contents of the reaction vessel and the temperature of the vessel was cooled to about 140° F.

About 2.2 weight percent 2-ethylhexyl acrylate was added to the reaction vessel and the temperature of the vessel was held at about 140° F. for about four hours.

The temperature of the reaction vessel was cooled to about 90°–100° F. and about 6.7 weight percent acrylic acid was added to the reaction vessel.

Into a mix tank were added about 2 weight percent benzophenone, about 0.1 weight percent glycol polysiloxane (Dow Corning DC-193), and about 2.2 weight percent 2-ethylhexyl acrylate with agitation.

The contents of the mix tank were added to the reaction vessel.

About 1.0 weight percent of benzoinisobutylether was added to the reaction vessel followed by about 2.2 weight percent 2-ethylhexyl acrylate.

The contents of the reaction vessel were agitated to insure complete dispersion of all ingredients and the resulting product was recovered as a free radical initiated ethylenically unsaturated polymerizable liquid coating composition suitable for use in the practice of this invention. The composition was tested and found to have a viscosity of 28,000 cps at 25° C. (Brookfield LVF, Spindle #4, 20 rpm.)

The various parameters which affect the amount of deglossing achieved using the method and apparatus of this invention are illustrated below in Tables I through VI. All samples to be treated were prepared in the same manner, that is, 40 filled vinyl floor tiles were wear layer coated with the composition of Example I to a thickness of about 6 mils. The tiles of Examples 40, 41, and 43 were coated with 6 mils of the specified coating compositions. All samples, other than the controls, were subjected to corona discharge treatment using the Rueggeberg corona discharge device described above. After corona treatment, all samples were bulk cured using a bank of ultraviolet lights and tested for gloss levels using a 60° Gardner glossmeter.

TABLE I

Deglossing Achieved at Various Treatment Levels

Constants: dielectric/coolant = transformer oil (1 gal/min) (Examples 1–8); ethylene glycol (1 gal/min) (Examples 9–15)
gap = 0.124 inch

| Example No. | Gas or Gas Mixture (liters/min) | Line Speed (fpm) | Power Input (watts) | Treatment Level[1] (watt-min/ft$^2$) | Gloss (60°) |
|---|---|---|---|---|---|
| Control | (untreated) | | | | 95 |
| 1 | Ar(49) & $CO_2$(5) | 40 | 108 | 2.5 | 85 |
| 2 | Ar(49) & $CO_2$(5) | 40 | 216 | 5 | 85 |
| 3 | Ar(49) & $CO_2$(5) | 20 | 216 | 10 | 63 |
| 4 | Ar(49) & $CO_2$(5) | 20 | 432 | 20 | 60 |
| 5 | Ar(49) & $CO_2$(5) | 10 | 432 | 40 | 42 |
| 6 | Ar(49) & $CO_2$(5) | 10 | 864 | 80 | 25 |
| 7 | Ar(49) & $CO_2$(5) | 10 | 1080 | 100 | 40 |
| 8 | Ar(49) & $CO_2$(5) | 5 | 864 | 160 | 12 |
| 9 | $N_2$(54) | 100 | 800 | 7.4 | 90 |
| 10 | $N_2$(54) | 80 | 800 | 9.2 | 87 |
| 11 | $N_2$(54) | 60 | 800 | 12.3 | 72 |
| 12 | $N_2$(54) | 40 | 800 | 18.5 | 25 |
| 13 | $N_2$(54) | 20 | 800 | 36.9 | 28 |
| 14 | $N_2$(54) | 10 | 800 | 73.9 | 3 |
| 15 | $N_2$(54) | 5 | 800 | 147.7 | 5 |

[1]Treatment Level $= \frac{Pa \times N}{d \times Vm} = \frac{\text{watts} \times \text{minutes}}{ft^2}$ Pa = power per electrode (watts)
N = number of electrodes
d = active corona length per electode (feet)
Vm = line or conveyor speed (feet/minute)

TABLE II

Deglossing Achieved Using Different Liquid Buffer Dielectric/Coolants

Constants: gas mixture = Ar(48.6 l/min.) & $CO_2$(5.4 l/min.)
line speed = 10 fpm
power input = 800 watts
gap = 0.124 inch
treatment level = 73.9 watt-min/ft$^2$

| Example No. | Dielectric/Coolant (Flow Rate in gal/min.) | Gloss (60°) |
|---|---|---|
| Control(untreated) | | 94 |
| 16 | ethylene glycol (1) | 20 |
| 17 | transformer oil (1) | 40 |

TABLE III

Deglossing Achieved by Varying Coating Composition Viscosity by Adding Ethylhexyl acrylate Constants: dielectric/coolant = transformer oil (1 gal/min)
gap = 0.124 inch
gas mixture = Ar(48.6 l/min) & $CO_2$(5.4 l/min.)
power input = 500 watts
line speed = 10 fpm
treatment level = 46.3 watt-min/ft.$^2$

| Example No. | Viscosity at 25° C. (Brookfield LVF Spindle #4, 20 rpm) | Gloss (60°) |
|---|---|---|
| Control | No adjustment (28,000 cps) | 30 |
| 18 | to 16,400 cps | 35 |
| 19 | to 10,200 cps | 20 |

TABLE IV

Deglossing Achieved by Varying Gap Between Electrode and and Coating Surface

Constants: dielectric/coolant = ethylene glycol (1 gal/min)
gas = $N_2$(54 l/min)
power input = 600 watts
line speed = 10 fpm
treatment level = 55.5 watt-min/ft$^2$

| Example No. | Gap Over Coating (Inches) | Gloss (60°) |
|---|---|---|
| 20 | 0.040 | 4 |
| 21 | 0.073 | 5 |
| 22 | 0.104 | 14 |
| 23 | 0.136 | 47 |
| 24 | 0.167 | 66 |
| 25 | 0.200 | 65 |

TABLE V

Deglossing Achieved Using Different Gases

Constants: dielectric/coolant = transformer oil (1 gal/min)
line gap = 10 fpm
gap = 0.124 inch
power input = 500 watts
treatment level = 46.3 watt-min./ft$^2$

| Example No. | Gas or Gas Mixture (l/min.) | Gloss (60°) |
|---|---|---|
| Control(untreated) | | 95 |
| 26 | Ar(54) | 3 |
| 27 | $CO_2$(54) | 35 |
| 28 | $N_2$(54) | 7 |
| 29 | He(54) | 3 |
| 30 | $N_2O$(54) | 57 |
| 31 | $CF_4$(54) | 62 |
| 32 | Ar(49) & $CO_2$(5) | 37 |
| 33 | He(27) & $CO_2$(27) | 45 |
| 34 | Ar(49) & He(5) | 3 |
| 35 | Ar(49) & $N_2O$(5) | 85 |
| 36 | Ar(49) & $CF_4$(5) | 3 |
| 37 | Ar(49) & $N_2$(5) | 3 |
| 38 | $N_2$(49) & Ar(5) | 5 |
| 39 | Ar(54) & $SF_6$(2.7) | |

TABLE VI

Deglossing Achieved by Using Different Coating Types

Constants: dielectric/coolant = ethylene glycol (1 gal/min)
line speed = 10 fpm

| Example No. | Coating Type & (Cure Mechanism) | Gas or Gas Mixture (liters/min) | Power Input (Watts) | gap (inch) | Treatment Level (Watt-min/.ft$^2$) | Gloss (60°) |
|---|---|---|---|---|---|---|
| 40 | polyene-polythiol[1] (uv) | Ar (54) | 700 | 0.192 | 64.8 | 5 |
| 41 | urethane acrylate[2] (uv-moisture) | Ar (54) $H_2O$ vapor* | 625 | 0.056 | 62.5 | 5 |
| 42 | urethane acrylate[3] (uv) | Ar (49) $CO_2$ (5) | 500 | 0.124 | 46.3 | 32 |
| 43 | acrylate polyester (uv) | Ar (49) $CO_2$ (5) | 500 | 0.124 | 46.3 | 50 |

[1]coating of Example I, U.S. Pat. No. 4,150,169
[2]coating of U.S. Pat. No. 4,138,299 (40% radiant energy/60% moisture curable)
[3]coating of Example I
*at more than 25% Relative Humidity It will be seen from the data set forth in Table I–VI that by selectively varying the parameters of the method of this invention, one is able to control the level of deglossing achieved using the method and apparatus of the present invention.

It will be evident from the foregoing that various modifications can be made to the present invention. Such, however, are considered as being within the scope of the invention.

What is claimed is:

1. A method for producing a radiant energy cured resinous coating having a reduced gloss level, wherein said coating does not require the presence of flatting pigments to achieve gloss reduction, which method comprises:

(a) coating the surface of a substrate with a liquid resinous coating composition curable by radiant energy;

(b) treating at least a portion of the surface of the liquid resinous coating with a corona discharge sufficient to reduce the gloss level of the coating in the treated portion; and (c) exposing the liquid resinous coating having a reduced gloss level to a dosage of radiant energy sufficient to polymerize the coating and set the reduced gloss level.

2. The method of claim 1 in which said liquid resinous coating composition is a free radical initiated ethylenically unsaturated polymerizable coating composition fully curable by ultraviolet light.

3. The method of claim 1 in which said liquid resinous coating composition is a free radical initiated polyene-polythiol polymerizable coating composition fully curable by ultraviolet light.

4. The method of claim 1 in which said corona discharge is produced by ionizing a gas or gas mixture which contains water vapor at more than about 25% relative humidity.

5. The method of claim 1 in which said substrate is a resilient floor covering material to be wear layer coated.

6. A method for producing a combined radiant energy and moisture cured resinous coating having a reduced gloss level, wherein said coating does not require the presence of flatting pigments to achieve gloss reduction, which method comprises:

(a) coating the surface of a substrate with a liquid resinous coating composition curable by a combined radiant energy and moisture cure;

(b) treating at least a portion of the surface of the liquid resinous coating with a corona discharge sufficient to reduce the gloss level of the coating in the treated portion;

(c) exposing the liquid resinous coating having a reduced gloss level to a dosage of radiant energy sufficient to polymerize the radiant energy curable components of the coating and set the reduced gloss level; and, (d) subjecting the radiant energy cured coating to a moisture cure to fully cure the coating.

7. The method of claim 6 in which said liquid resinous coating composition is a free radical initiated ethylenically unsaturated polymerizable coating composition curable by a combined radiant energy and moisture cure.

8. The method of claim 7 in which the radiant energy is ultraviolet light and the moisture cure consists of allowing the coating to age at room conditions.

9. The method of claim 6 in which said corona discharge is produced by ionizing a gas or gas mixture which contains water vapor at more than about 25% relative humidity.

10. The method of claim 6 in which said substrate is a resilient floor covering material to be wear layer coated.

* * * * *